US007857501B2

(12) United States Patent
Salathé

(10) Patent No.: US 7,857,501 B2
(45) Date of Patent: Dec. 28, 2010

(54) OBLIQUE TOURBILLON

(76) Inventor: Willy Salathé, Chemin du Roc 6a, CH-2533 Evilard (CH)

( * ) Notice: Subject to any disclaimer, the term of this patent is extended or adjusted under 35 U.S.C. 154(b) by 280 days.

(21) Appl. No.: 11/992,477

(22) PCT Filed: Sep. 22, 2006

(86) PCT No.: PCT/CH2006/000513

§ 371 (c)(1),
(2), (4) Date: Sep. 26, 2008

(87) PCT Pub. No.: WO2007/033513

PCT Pub. Date: Mar. 29, 2007

(65) Prior Publication Data

US 2009/0268565 A1 Oct. 29, 2009

(30) Foreign Application Priority Data

Sep. 23, 2005 (CH) ..... 1562/05

(51) Int. Cl.
*G04B 15/00* (2006.01)

(52) U.S. Cl. ..... 368/127

(58) Field of Classification Search ..... 368/124, 368/125, 127, 128, 142, 168, 169, 171
See application file for complete search history.

(56) References Cited

FOREIGN PATENT DOCUMENTS

| | | | |
|---|---|---|---|
| CH | 694 598 | A5 | 4/2005 |
| EP | 1 564 608 | A2 | 8/2005 |
| WO | WO 03/017009 | A2 | 2/2003 |
| WO | WO 2004/079459 | A2 | 9/2004 |

OTHER PUBLICATIONS

International Preliminary Report for PCT/CH2006/00513 (7 pages).
"Walter Prendel's 6-minute tourbillon," dated Sep. 10, 2002, http://www.network54.com (4 pages).

*Primary Examiner*—Vit W Miska
(74) *Attorney, Agent, or Firm*—Finnegan, Henderson, Farabow, Garrett & Dunner LLP

(57) ABSTRACT

A tourbillon is provided that includes a platform rotatable about a platform axis. In one implementation, the platform carries an escapement including an escape-wheel and pallets, wherein the escape-wheel is rotatable about an escape-wheel staff, the pallets are rotatable about a pallet-staff, and the escape-wheel staff and the pallet-staff are disposed so as to be essentially parallel to the platform axis. The platform also carries a balance-wheel rotatable about a balance-staff, wherein the balance-staff is arranged at an angle of inclination ∝ with respect to the platform axis.

12 Claims, 1 Drawing Sheet

OBLIQUE TOURBILLON

This application is a national stage filing under 35 U.S.C. §371 of International Application No. PCT/CH2006/000513, filed Sep. 22, 2006, which published in the German language, and which claims priority to Swiss (CH) Patent Application No. 1562/05, filed Sep. 23, 2005.

TECHNICAL FIELD

The present disclosure relates to the field of horology and, more specifically to embodiments of tourbillons or tourbillon modules.

BACKGROUND INFORMATION

Conventional watch movements include tourbillons in which the rotation axis of the balance wheel is arranged either parallel or perpendicular to the rotation axis of the tourbillon platform. In addition, tourbillons are known in which the rotation axis of the balance wheel is arranged at an angle to the rotation axis of the platform. The purpose of these devices is to prevent the positional inaccuracy of the balance wheel caused by overlapping motions. A very complicated example of a tourbillon is Walter Prendel's flying tourbillon created in 1928 (cf. http://www.network54.com). In that tourbillon, both the balance wheel and the escapement are disposed obliquely to the rotation axis of the tourbillon platform. The escapement is coupled to the balance wheel by a plurality of mechanical connections (gear pairs), resulting in a fascinating mechanism. However, a commercial implementation of Walter Prendel's flying tourbillon is not practical, due to its complicated structure.

EP1564608 discloses a tourbillon supported on both sides and in which the balance wheel and the escapement are disposed obliquely to the rotation axis of the platform. To ensure that the largest possible balance wheel results, the rotation axis of the balance wheel and the rotation axis of the rotating frame are arranged in one plane. Furthermore, the rotation axes of the escapement and of the balance wheel are arranged in parallel to one another. In order for the escape-wheel, which is arranged on the tourbillon platform, to rotate, it must be operatively linked to a fixed base. This is accomplished by means of a gear wheel with helical teeth. However, the manufacture of the gear wheel requires a relatively large outlay. Furthermore, straight teeth are easier to manufacture than helical teeth and may prevent gear hobbing caused by helical teeth. Additional problems arise from increased wear and tear owing to the surface unit pressure.

CH694598 discloses a multiple-axis tourbillon in which the balance wheel is arranged in a cage and rotates about three axes. This tourbillon also has a very complex design that ultimately provides little advantage with regard to accuracy.

SUMMARY

Consistent with embodiments of the present invention, a tourbillon is provided with an improved, positionally-optimised accuracy. Also, consistent with embodiments of the present invention, a tourbillon is provided that has improved sturdiness and a design that is comparably simple to manufacture and maintenance-friendly.

To achieve improved accuracy, the rotation axis of the balance wheel may be obliquely positioned by an angle $\propto$ relative to the rotation axis of the tourbillon in such a manner that with respect to watch movement and in addition to the actual pendular motion and the overlapping centric or eccentric rotary motion, the balance wheel executes a wobbling motion which, with a proper coupling between movable and immovable parts, positively influences accuracy. The angle $\propto$ may preferably lie in the 15° to 45° range. Other angles are also possible. Depending on the embodiment, the rotation axes of the balance wheel and the tourbillon platform may intersect, i.e. they may be positioned in the same plane, or they may be disposed out-of-square with respect to each other. In the instance of an out-of-square arrangement, the angle $\propto$ is the projection angle (angle of intersection) that can be seen when looking in the direction of the smallest distance between the two axes of rotation.

The rotation axes of the escapement, in particular of the escape-wheel and of the pallets, may be disposed substantially parallel to the rotation axis of the tourbillon platform since they do not particularly influence accuracy. An additional advantage consists in the construction of the tourbillon, which is substantially simpler compared to the construction of conventional tourbillons and may largely rely on existing, standardized parts.

The bridging of the inclined position between balance wheel and escapement may be effected as per embodiments of the invention by means of the design of the mechanical connection between the pallets and the balance-staff. In one embodiment, the pallets may include a fork on their side facing the balance-staff, and the balance-staff may include a protruding impulse pin having a bulbous, preferably spherical surface, both engaging with the other during unlocking. The impulse pin may preferably be manufactured of ruby or some other suitable material that enables the greatest possible frictionless mechanical transmission. Owing to the described exemplary configuration, the impulse pin easily compensates a vertical movement in the fork of the pallets resulting from the inclined position of the balance-staff and does so even in the instance of a greater inclined position of the rotation axis of the balance wheel with respect to the rotation axis of the pallets ($\propto \geqq 30°$). Owing to the spherical surface, a (relative) pendular motion arising in some embodiments can also be easily compensated for.

Alternatively, the impulse pin may be essentially cylindrical in design. In this embodiment, the engaging entry and exit faces (side flanges) of the fork exhibit an outwardly directed curvature that guarantees a controlled meshing with the impulse pin.

In accordance with another exemplary embodiment of the present invention, the tourbillon includes a platform, which is disposed so as to be rotatable about a platform axis. The platform includes an escapement with an escape-wheel and pallets, both of which are rotatable about an escape-wheel staff and about a pallet-staff. The staff of the escape-wheel and the pallet-staff may be disposed so as to be essentially parallel to the platform axis. Moreover, a balance wheel may be arranged on the platform, the balance wheel being rotatably arranged about a balance-staff. The balance-staff may be arranged at an angle of inclination $\propto$ with respect to the platform axis. Depending on the embodiment, the pallets include a fork that, upon each rotation of the balance wheel, temporarily meshes with an impulse pin which may have an essentially spherical locking surface. A locking pin may also be provided that cooperates with a conical locking surface, said locking surface having a groove running along the length of a surface line and preventing misoperation of the escapement. In one embodiment, the surface angle may correspond approximately to the angle of inclination $\propto$. In an additional embodiment, the surface angle may approximately be half as great as the angle of inclination $\propto$. In another embodiment, the balance-wheel may be held by a lower and by an upper balance-wheel bearing, the lower balance-wheel bearing being arranged above the main bearing and approximately on the same level as the tourbillon platform. Favourable results with respect to the wobbling motion have been achieved when the platform axis runs approximately through one of the balance-wheel bearings.

BRIEF DESCRIPTION OF THE DRAWINGS

The accompanying drawings, which are incorporated in and constitute a part of this specification, illustrate various embodiments of the invention. In the drawings.

DETAILED DESCRIPTION

Figure 1:
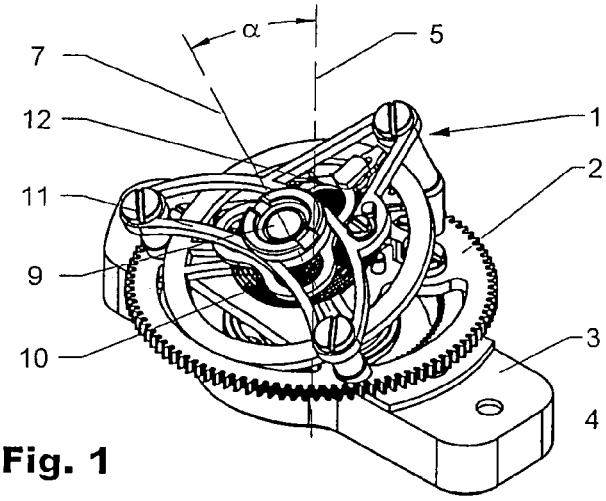
FIG. 1 shows a schematic diagram of an exemplary flying tourbillon from an angle from above, consistent with an embodiment of the invention.
Figure 2:
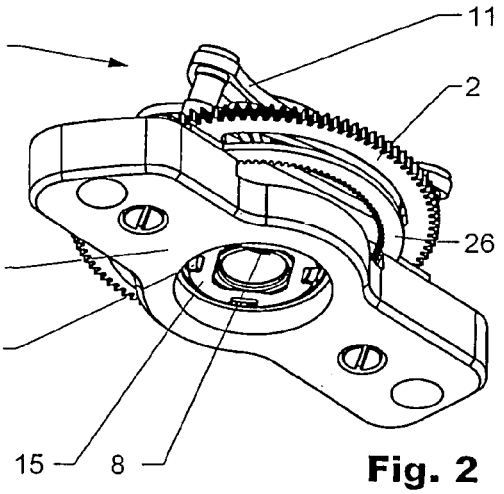
FIG. 2 shows a schematic diagram illustrating a view from an angle from below of the exemplary tourbillon of FIG. 1, consistent with an embodiment of the invention.

FIGS. 1 to 6 all show by way of example a flying tourbillon, or a tourbillon module 1. Corresponding parts therefore have the same reference number.

As is particularly clear from FIGS. 1-3 and 5, the tourbillon 1 substantially includes a tourbillon platform 2 that is opposite a tourbillon base 3 and rotatably mounted about a platform axis 5 by means of a ball bearing (main bearing) 4. A balance-wheel 6 that is rotatably mounted about a balance-staff 7 is arranged on the tourbillon platform 2. The balance-staff 7 is held by an upper and by a lower balance-wheel bearing 8, 9 that is fixed to the platform 2. A balance-spring 10 is operatively linked on one end to the balance-wheel 6 and in the area of the other end to a balance-cock 11, or may be operatively linked to an adjusting mechanism 12. The balance-cock 11 is supported by supports 17 opposite the platform 2. The balance-staff 7 is arranged at an angle of inclination $\propto$ with respect to the platform axis 5. In the exemplary embodiment illustrated, the platform axis 5 and the balance-staff 7 intersect or are disposed in one plane. Depending on the embodiment, it is possible for the axes to be disposed out-of-square with respect to each other. The effect of additional eccentricity and the associated advantages with respect to the wobbling motion are achieved because one of the balance-wheel bearings 8, 9 is arranged at approximately the point of intersection between the platform axis 5 and the balance-staff 7 in such a manner that the platform axis 5 does not pass through the centre of the balance-wheel 6.

Figure 6:
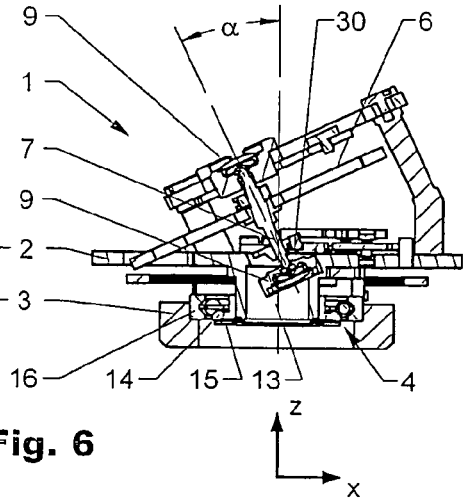
FIG. 6 shows a schematic diagram illustrating a cross-sectional view along the line of intersection DD of FIG. 5, consistent with an embodiment of the invention.

As illustrated in FIG. 6, the lower balance-wheel bearing 9 may be arranged above the ball bearing 4 (z-direction). The selected assembly makes maintenance of the lower balance-wheel bearing 8 possible from behind through an opening 18 in the platform 2.

The platform 2 has a bearing pin 13 that is driven in the inner race 14 of the ball bearing 4 and is prevented from falling out by a locking ring 15. The outer race 16 of the ball bearing 4 is driven in the platform 3.

Figure 3:
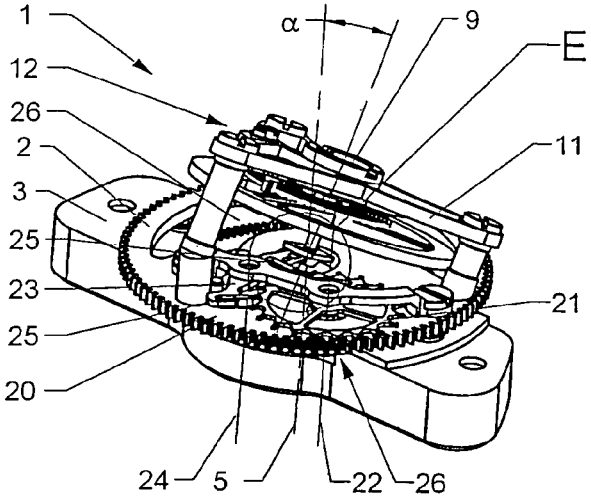
FIG. 3 shows a schematic diagram illustrating a side view of the exemplary tourbillon of FIG. 1, consistent with an embodiment of the invention.
Figure 4:
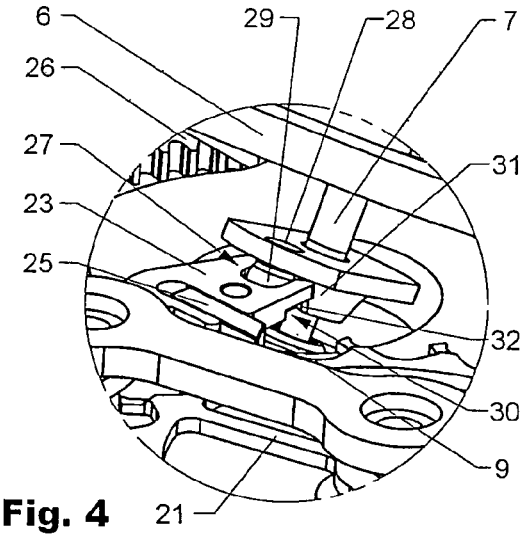
FIG. 4 shows a detailed illustration of element E from FIG. 3, consistent with an embodiment of the invention.
Figure 5:
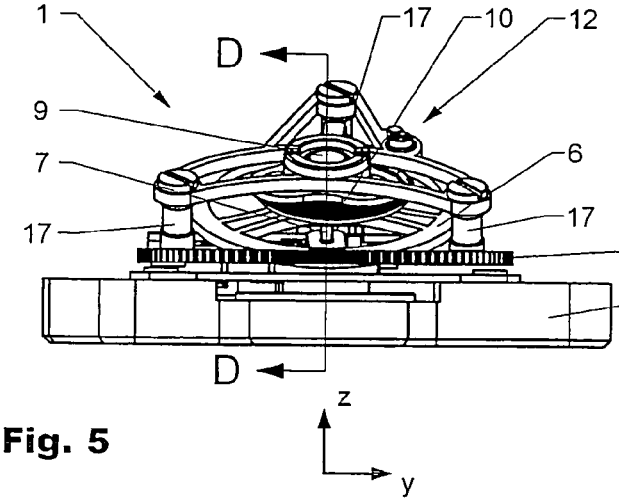
FIG. 5 shows a schematic diagram illustrating a front view of the exemplary tourbillon of FIG. 1, consistent with an embodiment of the invention.

FIG. 3 provides a view of the escapement 20 arranged on the platform 2 beneath the balance-wheel 6. Escapement 20 may be a pallet escapement having both an escape-wheel 21 rotatably arranged about an escape-wheel staff 22 as well as pallets 23 that are movably arranged about a pallet-staff 24. The escape-wheel 21 is operatively linked to an escape-pinion 25 by means of the escape-wheel staff 22, which escape-pinion 25 meshes with, in this instance, an internally toothed gear wheel 26 that is securely mounted on the tourbillon base 3 and is concentrically arranged with respect to the platform axis 5. When the tourbillon platform 2 rotates about the platform axis 5, the escape-pinion 25 rolls in the interior of the gear wheel 26, thereby causing the escape-wheel 21 to rotate about the escape-wheel staff 22.

In contrast to the balance-wheel 6, the escapement 20 can be arranged in the plane of the platform 2 so that the escape-wheel staff 22 and the pallet-staff 24 are arranged parallel to the platform axis 5. The pallets 23 may include, for example, two pallet jewels 25 (entry and exit pallets) by means of which it is operatively linked to the escape-wheel 21. Furthermore, pallets 23 may include a fork 27 (cf. FIG. 4) that, upon each passage of the balance-wheel 6, temporarily engages with an impulse pin 28 that is operatively linked to the balance-wheel 6. In the embodiment shown, in the area in which the impulse pin 28 meshes with the fork 27 of the balance-wheel 6, the impulse pin exhibits a substantially spherical surface 29 that brings about an optimized gear hobbing with respect to the fork 27. A guard pin 30 is arranged beneath the fork 27 (cf. FIG. 4 and FIG. 5), which guard pin is substantially directed in the direction of the fork 27 and prevents pallets 23 from prematurely engaging with impulse pin 28 or alternatively prevents a malfunction. Guard pin 30 interacts with a substantially conical locking surface 31 that is concentrically aligned with the balance-staff 7 and rotates therewith. The conicity of the locking surface 31 ensures that the guard pin 30 abuts against a surface line of the locking surface 31 in such a manner that no negative point loads result. Locking surface 31 is interrupted in the area of the impulse pin 28 by a groove 32 that runs parallel to said locking surface 31. Groove 32 may be designed in such a manner that the guard pin 30 that abuts against the locking surface 31 engages in the groove 32. In this manner, the engagement of the impulse pin 28 is also allowed into the fork 27 in such a manner that an additional impulse is transferred from the pallets 23 to the balance-wheel 6. In the exemplary embodiment shown, the surface angle (angle between a surface line and the balance-staff) of the conical locking surface 31 is equal in size to the angle $\propto$ between the balance-staff 7 and the platform axis 5. In an additional embodiment, the surface angle may be approximately equivalent to $\propto/2$ and the locking pin accordingly exhibits a correspondingly appropriate interaction surface in the contact area (not visible).

Using the device described, it is possible to achieve with a comparably simple mechanism in one step a large inclination of the balance-staff 7 with respect to the platform axis 5.

The foregoing description has been presented for purposes of illustration and is not exhaustive and does not limit the invention to the precise forms or embodiments disclosed. Modifications and adaptations of the various embodiments of the invention can be made. For example, one or more steps of the methods described above may be performed in a different order or concurrently and still achieve desirable results.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

The invention claimed is:

1. A tourbillon comprising:

a platform rotatable about a platform axis, the platform carrying:

an escapement including an escape-wheel and pallets, wherein the escape-wheel is rotatable about an escape-wheel staff, the pallets are rotatable about a pallet-staff, and the escape-wheel staff and the pallet-staff are disposed so as to be essentially parallel to the platform axis; and a balance-wheel that is rotatable about a balance-staff, wherein the balance-staff is arranged at an angle of inclination $\propto$ with respect to the platform axis.

2. The tourbillon of claim 1, wherein the pallets include a fork that, upon rotation of the balance-wheel, temporarily meshes with an impulse pin comprising an essentially spherical locking surface.

3. The tourbillon of claim 2, wherein the pallets further comprise a locking pin that cooperates with a conical locking surface, the conical locking surface including a groove running along the length of a surface line and preventing misoperation of the escapement.

4. The tourbillon of claim 3, wherein the surface line of the conical locking surface presents a surface angle corresponding approximately to the angle of inclination $\propto$.

5. The tourbillon of claim 3, wherein the surface line of the conical locking surface presents a surface angle corresponding approximately to half the size of the angle of inclination $\propto$.

6. The tourbillon of claim 1, wherein the balance-wheel is held by a lower and an upper balance-wheel bearing, the lower balance-wheel bearing being arranged above a main bearing of the tourbillon platform and approximately on the same level as the tourbillon platform.

7. The tourbillon of claim 2, wherein the balance-wheel is held by a lower and an upper balance-wheel bearing, the lower balance-wheel bearing being arranged above a main bearing of the tourbillon platform and approximately on the same level as the tourbillon platform.

8. The tourbillon of claim 3, wherein the balance-wheel is held by a lower and an upper balance-wheel bearing, the lower balance-wheel bearing being arranged above a main bearing of the tourbillon platform and approximately on the same level as the tourbillon platform.

9. The tourbillon of claim 4, wherein the balance-wheel is held by a lower and an upper balance-wheel bearing, the lower balance-wheel bearing being arranged above a main bearing of the tourbillon platform and approximately on the same level as the tourbillon platform.

10. The tourbillon of claim 6, wherein the platform axis runs approximately through at least one of the lower balance-wheel bearing and the upper balance-wheel bearing.

11. The tourbillon of claim 1, wherein the tourbillon is a flying tourbillon comprising a bearing on one side for connecting the tourbillon to a watch movement.

12. The tourbillon of claim 6, wherein the tourbillon is a flying tourbillon comprising a bearing on one side for connecting the tourbillon to a watch movement.

* * * * *